US008770070B2

(12) United States Patent
Liu

(10) Patent No.: US 8,770,070 B2
(45) Date of Patent: Jul. 8, 2014

(54) UNIVERSAL ANTI-TORQUE SCREWDRIVER HEAD STRUCTURE

(76) Inventor: Tsai-Fa Liu, Taichung (TW)

( * ) Notice: Subject to any disclaimer, the term of this patent is extended or adjusted under 35 U.S.C. 154(b) by 219 days.

(21) Appl. No.: 13/454,046

(22) Filed: Apr. 23, 2012

(65) Prior Publication Data

US 2013/0276595 A1 Oct. 24, 2013

(51) Int. Cl.
*B25B 15/00* (2006.01)

(52) U.S. Cl.
CPC ..... *B25B 15/005* (2013.01)
USPC ..... 81/460; 81/438

(58) Field of Classification Search
CPC .. B25B 15/005; B25B 15/007; F16B 23/0023
USPC ..... 81/436–438, 460, 461; D8/86
See application file for complete search history.

(56) References Cited

U.S. PATENT DOCUMENTS

| | | | | |
|---|---|---|---|---|
| 4,084,478 | A * | 4/1978 | Simmons | 411/404 |
| 4,380,942 | A * | 4/1983 | Fenton | 81/436 |
| 5,868,047 | A * | 2/1999 | Faust et al. | 81/438 |
| 6,655,241 | B2 * | 12/2003 | Kozak | 81/460 |
| 7,162,939 | B2 * | 1/2007 | Totsu | 81/460 |
| 7,322,265 | B2 * | 1/2008 | Chen | 81/460 |
| 8,166,851 | B2 * | 5/2012 | Pchola et al. | 81/460 |
| 2010/0288086 | A1 * | 11/2010 | Huang | 81/460 |

* cited by examiner

*Primary Examiner* — David B Thomas

(57) ABSTRACT

The present invention discloses a universal anti-torque screwdriver head structure integrally formed and divided into a polygonal insert end and a conical action end, and comprising a plurality of pull-push wings disposed around the action end, a stepped recessed formed between two adjacent pull-push wings and extended inwardly from an open end, and the recess having a longitudinal depth slightly greater than an action hole of a screw of a general specification, and the design of the stepped recess provides high-strength torque and tenacity and fits screws of various different specifications.

2 Claims, 3 Drawing Sheets

UNIVERSAL ANTI-TORQUE SCREWDRIVER HEAD STRUCTURE

BACKGROUND OF THE INVENTION

1. Fields of the Invention

The present invention relates to a universal anti-torque screwdriver head structure, and more particularly to a practical and convenient screwdriver head capable of maintaining the original tenacity, improving the rigidity of the structure to extend the service life, and fitting screws of various different specifications.

2. Description of the Related Art

In general, screwdriver head is combined with a rotating tool such as a wrench or a screwdriver (not shown in the figure) and used for screwing or securing various different screw workpieces. With reference to FIGS. 4 and 5 for schematic views of a conventional screwdriver head 10 with special design and specification and its specified screw 20 respectively, the screwdriver head 10 has a stepped recess 13 formed at an action end 11 of the screwdriver head 10 and between two adjacent pull-push wings 12 and having a very small longitudinal depth, and a stepped action hole 21 formed at the specified screw 20 and having corresponding size and shape of the action end 11, so that after the stepped recess 13 and the stepped action hole 21 are combined, the pull-push wing 12 of the action end 11 of the screwdriver head 10 with the special specification and the stepped recess 13 can be embedded into the stepped action hole 21 of the screw 20 to constitute a closely attached and multi-directionally engagement, so as to provide a good transmission of the applied force.

As we all know, a screw 30 with the common specification and generally available in the market is used extensively as shown in FIG. 6. The stepped recess 13 of the screwdriver head 10 having a general action hole 31 and provided for a screw 30 with a general specification becomes useless, mainly because the too-large action end 11 cannot be inserted successfully into the smaller action hole 31 of the screw 30 of the general specification (in other words, the two have different sizes), so as to reduce the scope of applicability, the practicality and value of the screwdriver head.

Since the stepped recess 13 has a very small longitudinal depth, torque or stress cannot be produced between an applied force and a received force (or the moment arm between the applied force and the received force is too short), and the torque strength of the action end 11 and the pull-push wing 12 may be insufficient, and the service life may be shortened (or the action end 11 may be deformed, cracked or broken easily).

SUMMARY OF THE INVENTION

In view of the aforementioned problems, the inventor of the present invention based on years of experience to conduct extensive researches and experiments and finally developed a screwdriver head of the present invention. Therefore, it is a primary objective of the present invention to provide a screwdriver head with the existing concept of the stepped recess, and adjust the depth of the stepped recess appropriately, so that the screwdriver head can be applied in screws of different specifications without being limited to any particular specific specification, so as to enhance the practical value of the screwdriver head. In the meantime, the moment arm between the applied force and the received force can be adjusted or elongated effectively to improve the torque strength of the action end and the pull-push wing and extend the service life.

According to the invention, a universal anti-torque screwdriver head structure is integrally formed and divided into a polygonal insert end and a conical action end, and comprises a plurality of pull-push wings disposed around the action end, a stepped recessed formed between two adjacent pull-push wings and extended inwardly from an open end, and the recess having a longitudinal depth slightly greater than an action hole of a screw of a general specification. The design of the stepped recess provides high-strength torque and tenacity and fits screws of various different specifications.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
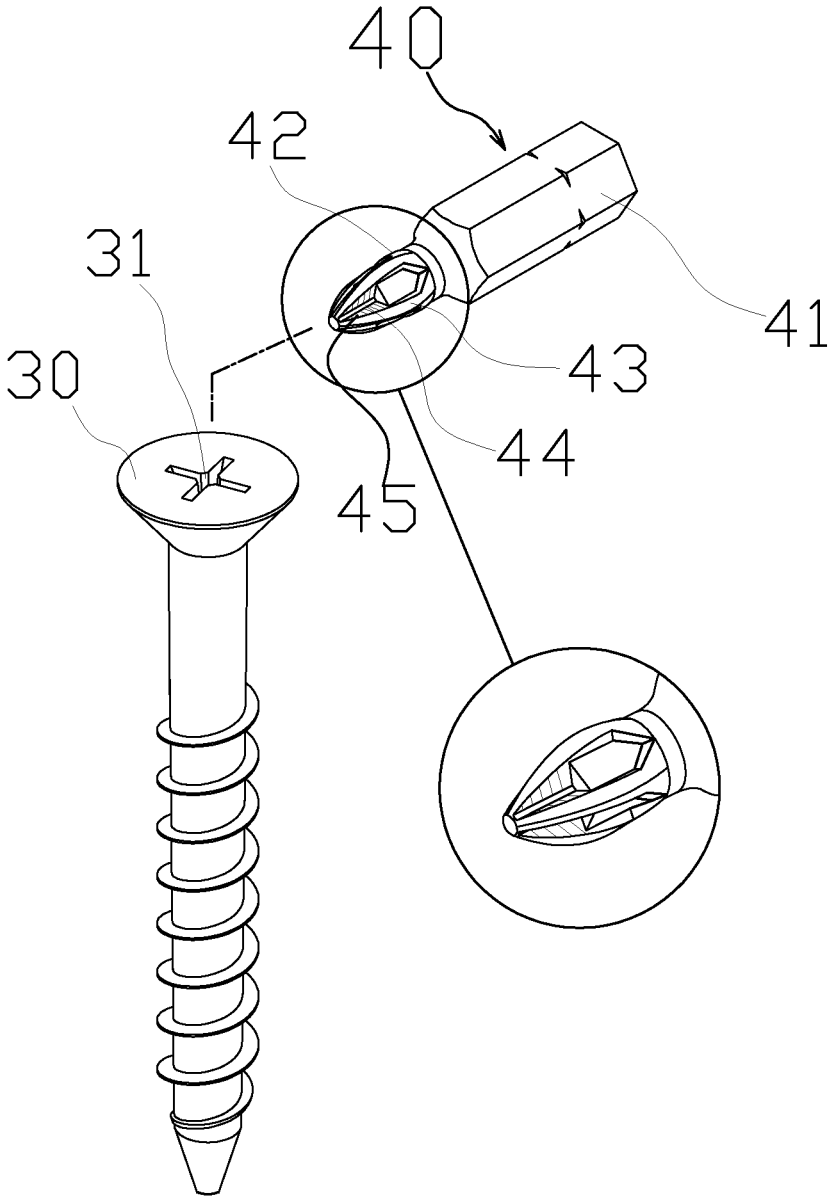
FIG. 1 is a perspective view of the present invention and a screw of a general specification.
Figure 3:
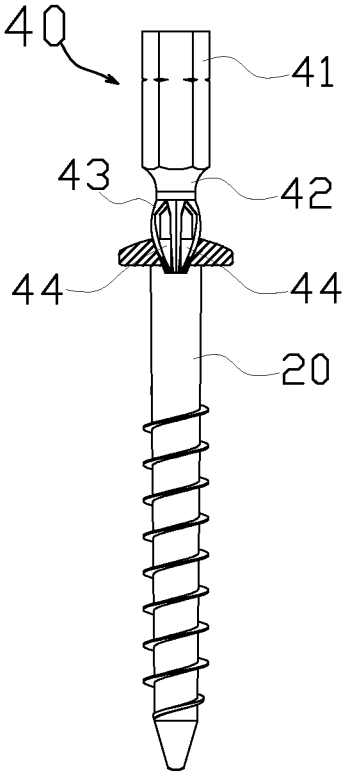
FIG. 3 is a schematic view of combining and using the present invention and a screw of a special specification screw.
Figure 2:
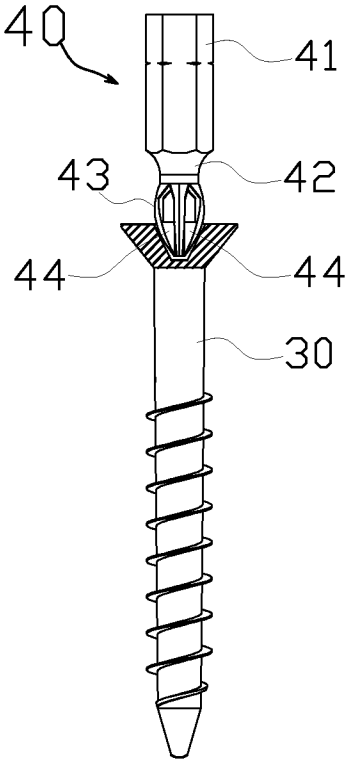
FIG. 2 is a schematic view of combining and using the present invention as depicted in FIG. 1.
Figure 6:
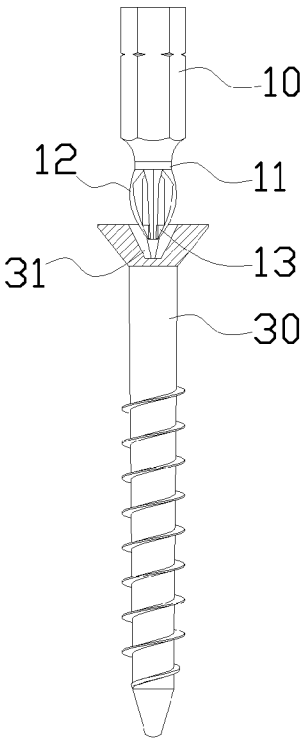
PRIOR ART FIG.6
FIG. 6 is a schematic view of combining and using a conventional screw driver head of a special specification screwdriver head and a screw of a general specification.
Figure 5:
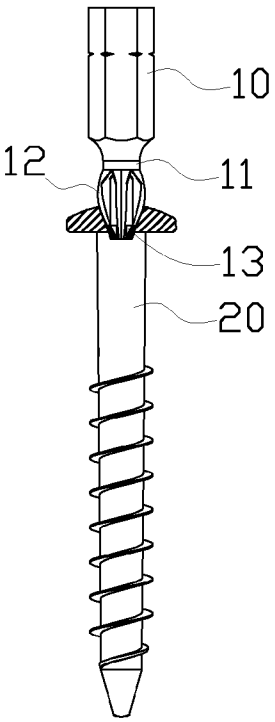
PRIOR ART FIG.5
FIG. 5 is a schematic view of combining and using the screw driver head and screw as depicted in FIG. 4.
Figure 4:
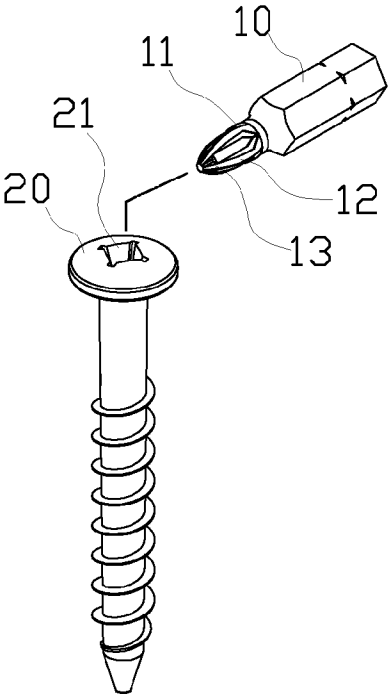
PRIOR ART FIG.4
FIG. 4 is perspective view of a conventional screw driver head of a specific specification and its specified screw.

The technical measures and characteristics of the present invention will become apparent with the detailed description of preferred embodiments accompanied with related drawings as follows:

With reference to FIGS. 1 and 2, the screwdriver head 40 is integrally formed and divided into a polygonal insert end 41 and a conical action end 42, wherein the action end 42 includes a plurality of pull-push wings 43 disposed around the action end 42, a stepped recess 44 formed between two adjacent pull-push wings 43 and extended from an open end of the action end 42, and the recess 44 having a longitudinal depth slightly greater than the depth of the action hole 31 of the screw 30, such that the design of the stepped recess 44 can provide high-strength torque and tenacity and fit screws 20, 30 of various different specifications.

In addition, a non-skid thread 45 is formed at a cross-section of the stepped recess 44 of the action end 42 and provided for enhancing the non-skid effect.

With the aforementioned design, the screwdriver head 40 of the present invention is applied to a conventional screw 20 of a special specification, and the stepped action hole 21 of the specified screw 20 will not affect the insertion and use of the two, so as to extend the scope of applicability and practicality of the present invention.

Since the action end 42 of the present invention is combined tightly with the action holes 30, 31 of different screws 20, 30, therefore the application has a better stability and a smaller deformation caused by the received force, so as to prevent the deformation and breaking effectively.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A universal anti-torque screwdriver head structure, integrally formed and divided into a polygonal insert end and a conical action end, and comprising a plurality of pull-push wings disposed around the action end, a stepped recess formed between two adjacent pull-push wings and extended inwardly from an open end, and the recess having a longitudinal depth slightly greater than an action hole of a screw of a general specification.

2. The universal anti-torque screwdriver head structure of claim 1, further comprising a non-skid thread formed on each cross-section of the stepped recess of the action end.

* * * * *